United States Patent [19]

Bardsley et al.

[11] 4,420,124

[45] Dec. 13, 1983

[54] CARPET ROLLING MACHINE

[75] Inventors: Harold B. Bardsley, Chorley; Brian J. Mosby, Blackpool; John M. Barlow, Chorley; Brian Walton, Blackburn, all of England

[73] Assignee: Spencer Wright Industries, Inc., Chattanooga, Tenn.

[21] Appl. No.: 412,600

[22] Filed: Aug. 30, 1982

[30] Foreign Application Priority Data

Nov. 5, 1981 [GB] United Kingdom ..... 8133357

[51] Int. Cl.[3] ..... B65H 17/12

[52] U.S. Cl. ..... 242/66; 242/67.2; 242/68.7

[58] Field of Search ..... 242/66, DIG. 3, 68.7, 242/67.1 R, 67.2, 67.4

[56] References Cited

U.S. PATENT DOCUMENTS

| | | | |
|---|---|---|---|
| 2,573,188 | 10/1951 | Dyken | 242/66 |
| 2,961,182 | 11/1960 | Beerli | 242/66 |
| 3,049,311 | 8/1962 | Birch, Jr. | 242/66 X |
| 3,850,381 | 11/1974 | Moore | 242/66 |
| 3,961,759 | 6/1976 | Fujiwara | 242/66 |
| 4,002,308 | 1/1977 | Feighery | 242/66 |
| 4,157,794 | 6/1979 | Brandauer et al. | 242/66 |

*Primary Examiner*—Stuart S. Levy
*Assistant Examiner*—Scott J. Haugland
*Attorney, Agent, or Firm*—Alan Ruderman

[57] ABSTRACT

A carpet roll machine having a pair of drivable rollers arranged to define a supporting nip on which a roll of carpet can be formed. A lower deflector between the rollers and in sliding contact with at least one of them selectively presents an upwardly facing slide surface. An upper deflector is moveable between a first position wherein it is disposed above the lower deflector and a rest position remote from the first position. In the first position the upper deflector presents a downwardly facing slide surface which together with the slide surface of the lower deflector and the adjacent rollers define a cylindrical space into which the end of a piece of carpet can be fed and constrained to follow a cylindrical path to form an incipient roll. The lower deflector is pivotable between positions wherein it contacts one or the other of the rollers enabling a pile-in or pile-out roll to be formed. A gate is provided upstream of the lower deflector to direct the feed end to one or the other side of the lower deflector.

10 Claims, 7 Drawing Figures

CARPET ROLLING MACHINE

BACKGROUND OF THE INVENTION

This invention relates to a carpet rolling machine which can be used to form a roll as carpet is manufactured, or comes from a final treatment machine after a manufacturing process, or as carpet is fed from a storage roll of large size in a warehouse or the like.

Heretofore it has been common practice for the edge of a piece of carpet to be manually turned to form an incipient roll supported by two or more rollers which are then rotated to complete the operation. This process has two basic disadvantages. Firstly, carpet is often produced and handled in widths of three meters or more, so that the initial manual forming of an incipient roll, with or without a central supporting tube needs three persons and a degree of skill. If the operation is badly performed the resultant roll may be creased or otherwise malformed resulting in damage to the carpet. Secondly, the rollers used are often of the type having spaced annular gripping means, resembling vehicle tires, which can in certain circumstances cause damage to the carpet face or to delicate backings such as foamed plastic materials. A still further disadvantage of such machines is that when carpet is fed to them in a particular disposition, i.e. pile up or pile down, they can only form a roll with the pile directed inwardly or outwardly as the case may be. It is desirable that whatever the original disposition of the carpet a rolling machine should be able to form a pile-in or pile-out roll at will to enable the better form of roll to be selected having regard to the properties of the pile and backing.

A number of proposals have been made to eliminate the aforesaid disadvantages. For example, in U.S. Pat. No. 3,850,381 a carpet rolling machine is proposed utilizing as guides flexible bands connected to rollers and act in conjunction with four carpet support rollers to effect either a face-in or face-out rolling of the carpet, the rotational direction of the support rollers being varied accordingly. When pile-out is to be formed a fifth roller is bodily moved from a remote position toward the four rollers. The carpet roll is formed between the nip of the support rollers, the upper two of which are moved away from the lower pair as the carpet roll grows. Also as the carpet roll grows the entire carpet roll will walk over the lower pair of rollers toward the fifth roller. Since the support rollers have annular gripping means the aforesaid disadvantage of potential damage to the carpet face or to delicate backings remains a problem.

In U.S. Pat. No. 4,002,308 a carpet roll is formed in the nip between a pair of lower fixed axis rollers and a pair of upper moveable axis rollers which are bodily moved apart as the carpet roll grows. Pile-in or pile-out is obtained by controlling the rotational direction of the rollers. Thus, in both of the aforesaid patents an incipient carpet roll is formed between the nip of four rollers and control means must be provided for bodily moving two of the rollers as the carpet roll grows. Again the potential for damage to the carpet face or delicate backings is present.

SUMMARY OF THE INVENTION

Consequently, it is a primary object of the present invention to provide a carpet rolling machine in which an incipient roll may be formed in either a pile-in or pile-out disposition in the nip between just a pair of rollers.

It is another object of the present invention to provide a carpet rolling machine having a simple effective means for directing the end of a strip of carpet toward a carpet roll forming disposition for forming a pile-in or pile-out carpet roll.

It is a further object of the present invention to provide a carpet roll forming machine having an arrangement of moveable deflectors for guiding the end of a strip of carpet to the nip between a pair of rollers for forming a roll of carpet having either a pile-in or pile-out disposition.

Accordingly, the present invention provides a carpet rolling machine comprising: a pair of drivable rollers arranged to define a supporting nip on which a roll of carpet can be formed; a lower deflector between the rollers and in sliding contact with at least one of them presenting an upwardly facing slide surface; and an upper deflector movable between a first position wherein it is disposed above the lower deflector and presents a downwardly facing slide surface, the two slide surfaces and the adjacent rollers defining a generally cylindrical space to which an end of a piece of carpet can be fed and wherein such end is constrained to follow a cylindrical path to form an incipient roll, the upper deflector having a second or rest position remote from the first position.

One or both of the slide surfaces can be cam surfaces such as smooth part-cylindrical surfaces or can incorporate one or more smaller rollers driven or undriven.

The lower deflector can be pivotable between positions wherein it contacts one or other of the rollers enabling a carpet end to be fed into the space in a left-hand or right-hand direction enabling a pile-in or pile-out roll to be formed irrespective of the original disposition of the end coming to the machine. A gate, constituted for example by a pivotable flap, can be provided upstream of the lower deflector to direct the fed end to one or other side of the lower deflector.

The two rollers are preferably driven so that the second of them, considered in relation to the direction of feed of the carpet end, can be rotated faster than the first to ensure a tight wrap. The roll can be formed about a central tube, arranged in the space to define therewith an annular void, or can be formed without such a roll if the carpet is of suitable construction.

The upper deflector can be mounted at one end of a pair of arms whose other ends are pivoted to a frame of the machine, fluid cylinders or other actuators being provided to move the upper deflector between its two positions. The lower deflector and the gate can also have fluid cylinders or other actuators arranged to move them between their respective two positions.

Advantageously a roll discharge mechanism is provided in the form of a beam carried by respective one ends of a pair of arms whose other ends are pivoted to the machine frame, fluid cylinders or other actuators being provided to cause pivoting of the arms to cause the beam to move a completed roll from its position supported by the rollers out of the machine.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
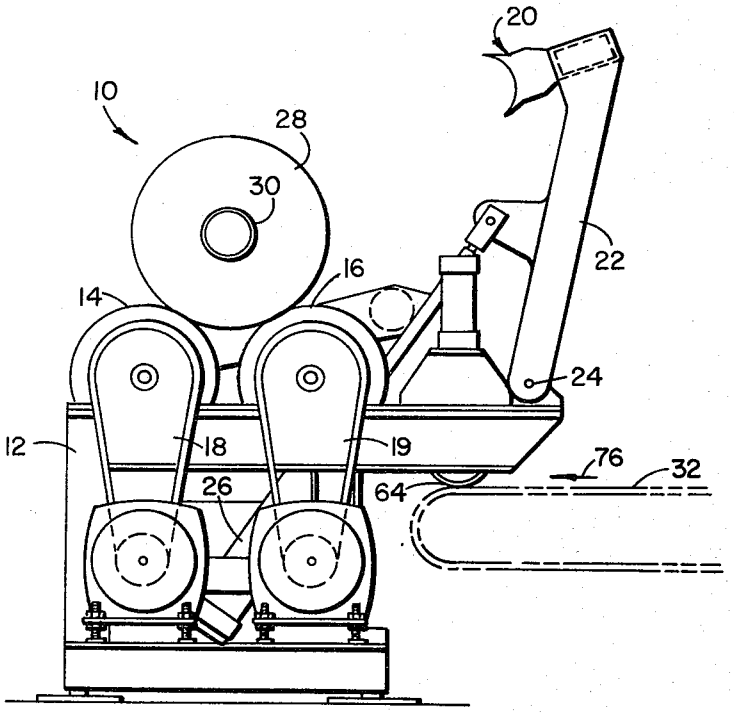
FIG. 1 is an end elevational view of a machine constructed in accordance with the principles of the invention.

A preferred carpet rolling machine 10 of the invention (FIG. 1) has a frame 12, a pair of roll supporting and forming rollers 14, 16 arranged parallel and side-by-side and each independently driven by a respective drive 18, 19. FIG. 1 also shows an upper deflector 20 of the machine mounted on a set of arms 22 pivotably attached to the frame 12 at 24 and movable by means of fluid cylinders 26. There is also shown a formed roll 28 of carpet which, if desired, may be disposed about a tube 30. Carpet can be fed to the machine 10 by means of a conventional conveyor 32.

Figure 2:
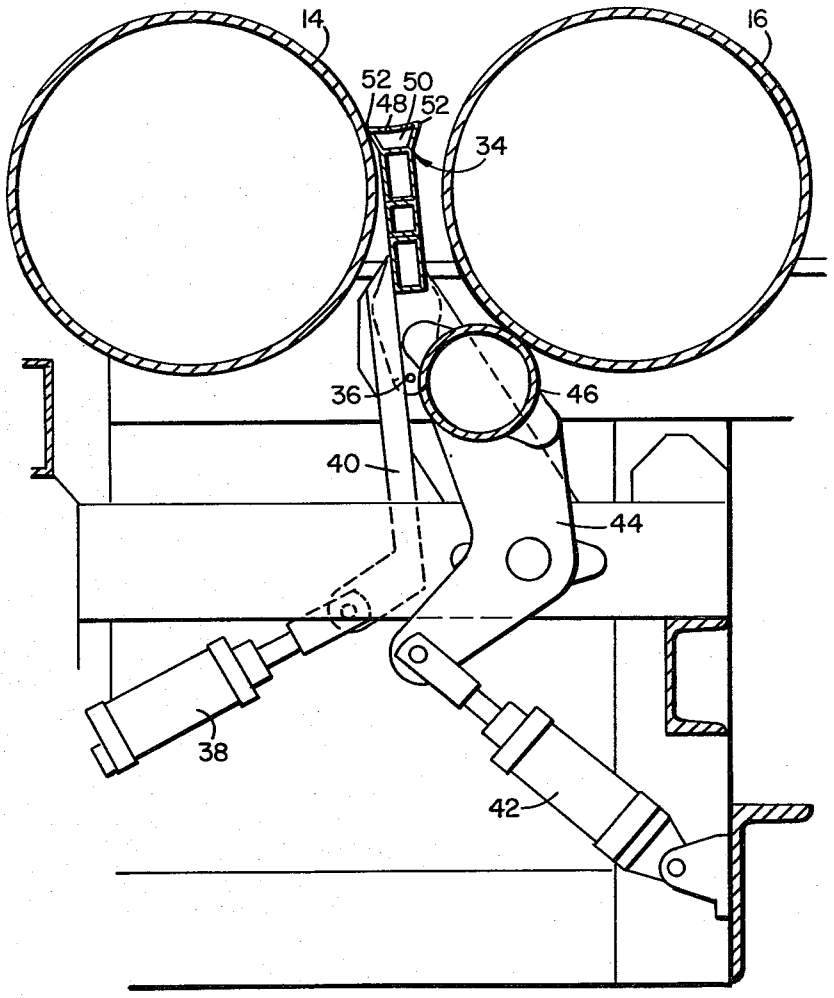
FIG. 2 is an enlarged end elevational view, partly in section, illustrating a portion of the machine of FIG. 1 and depicting the lower deflector.

A lower deflector generally indicated at 34 in FIG. 2 preferably is in the form of a beam extending longitudinally of and between rollers 14, 16 and pivotally mounted about an axis 36 to enable it to contact one or the other of the rollers 14, 16 by means of an actuator in the form of a fluid cylinder 38 acting on an arm 40. Also shown in FIG. 2 is a fluid cylinder 42 and arm 44 which can move a primary feed roller 46 whose function will be described hereinafter in relation to FIG. 4.

The lower deflector 34 has an upper operative cam preferably in the form of a part-cylindrical slide surface 48 on the top of a trapezoidal member 50, which cam has one or the other of a pair of lips 52 in sliding contact with roller 14 or 16 selectively. Member 50 may be of nylon or similar material able to contact the rollers 14, 16 without causing damage.

Figure 3:
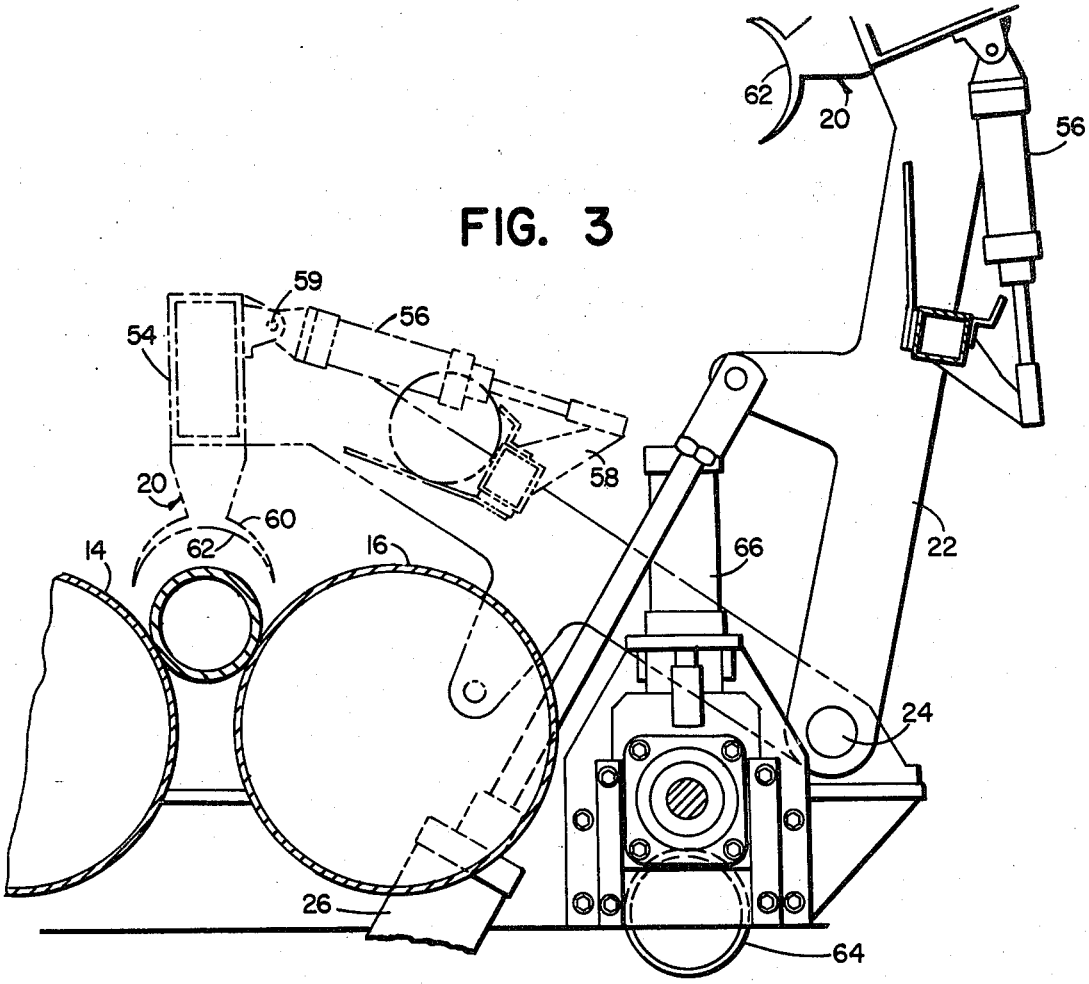
FIG. 3 is a similar view illustrating an upper deflector of the machine.

In FIG. 3 the upper deflector 20 is shown in an operative position in dotted lines and in a rest position in full lines. Deflector 20 may also be in the form of a beam 54 extending the length of rollers 14, 16 and mounted on arms 22 pivoted at 24 and movable by cylinders 26. Auxiliary cylinders 56 supported by an arm 58 carried by the arm 22 can pivot the beam 54 about an axis 59. The beam 54 carries an inverted channel section member 60 which in operative disposition presents a downwardly facing cam surface preferably also being a part-cylindrical slide surface 62.

Also shown in FIG. 3 is a drivable roller 64 which can be moved vertically by fluid cylinders 66 so as to the drive conveyor 32 and initiate the feed of a carpet end into the machine. This arrangement may be used particularly in warehouses wherein a stock roll will be arranged to unwind on or onto conveyor 32 and lengths are cut therefrom.

Figure 4:
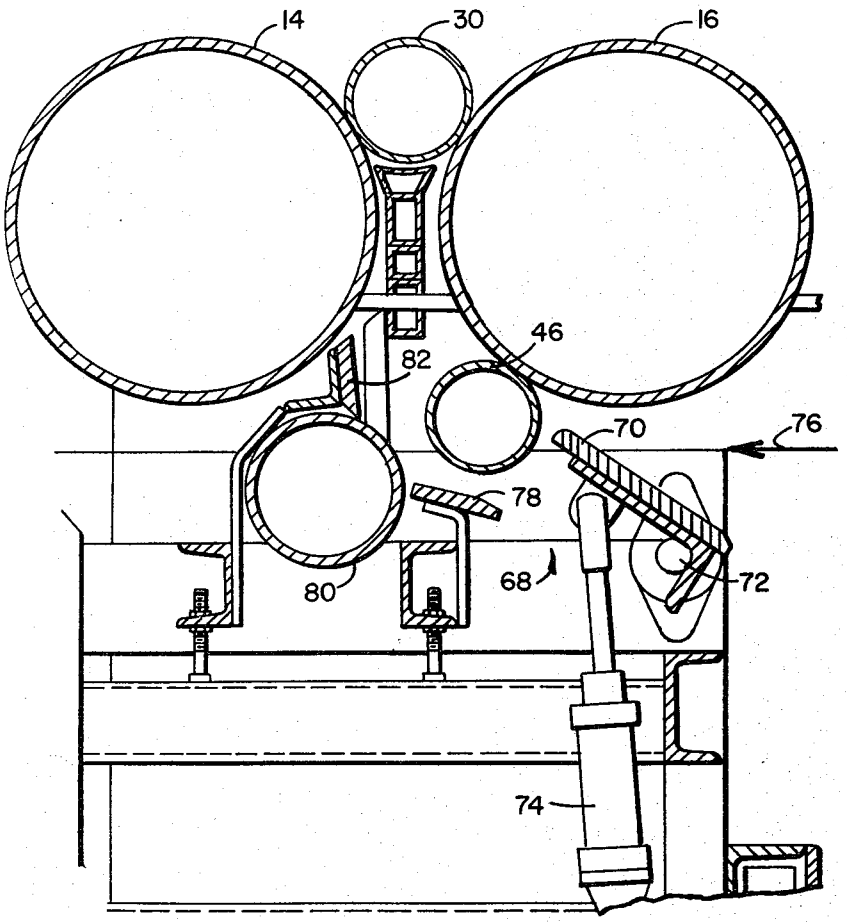
FIG. 4 is a partial cross sectional view taken intermediate the ends of the machine illustrating a feed mechanism of the machine.

A feed mechanism of the machine generally indicated at 68 in FIG. 4 has a gate flap deflector 70 pivotable about an axis 72 by fluid cylinders 74 and can deflect a carpet end fed in the direction of arrow 76 to pass above or below the primary feed roller 46. A first guide ramp 78 is fixed to a bracket below the roller at a slight inclination and has its upper surface disposed along a plane intersecting a second feed roller 80. The roller 80 is disposed below the rollers 14 and 46 and has its axis in a vertical plane intermediate the axes of the rollers 14 and 46. Disposed above the roller 80 and below the roller 14 is a second fixed guide ramp 82 having a surface inclined along a plane intersecting the rollers 14 and 46. When carpet is fed below roller 46 the carpet is guided to the left of the lower deflector 34 by the secondary feed roller 80 and the guide ramps 78 and 82 toward the surface of the roller 14. Although by positioning the ramp 78 and roller 46 relative to the roller 16 bodily movement of the roller 46 may not be necessary, it is preferred to bodily move the roller 46 to reduce wear.

Figure 5:
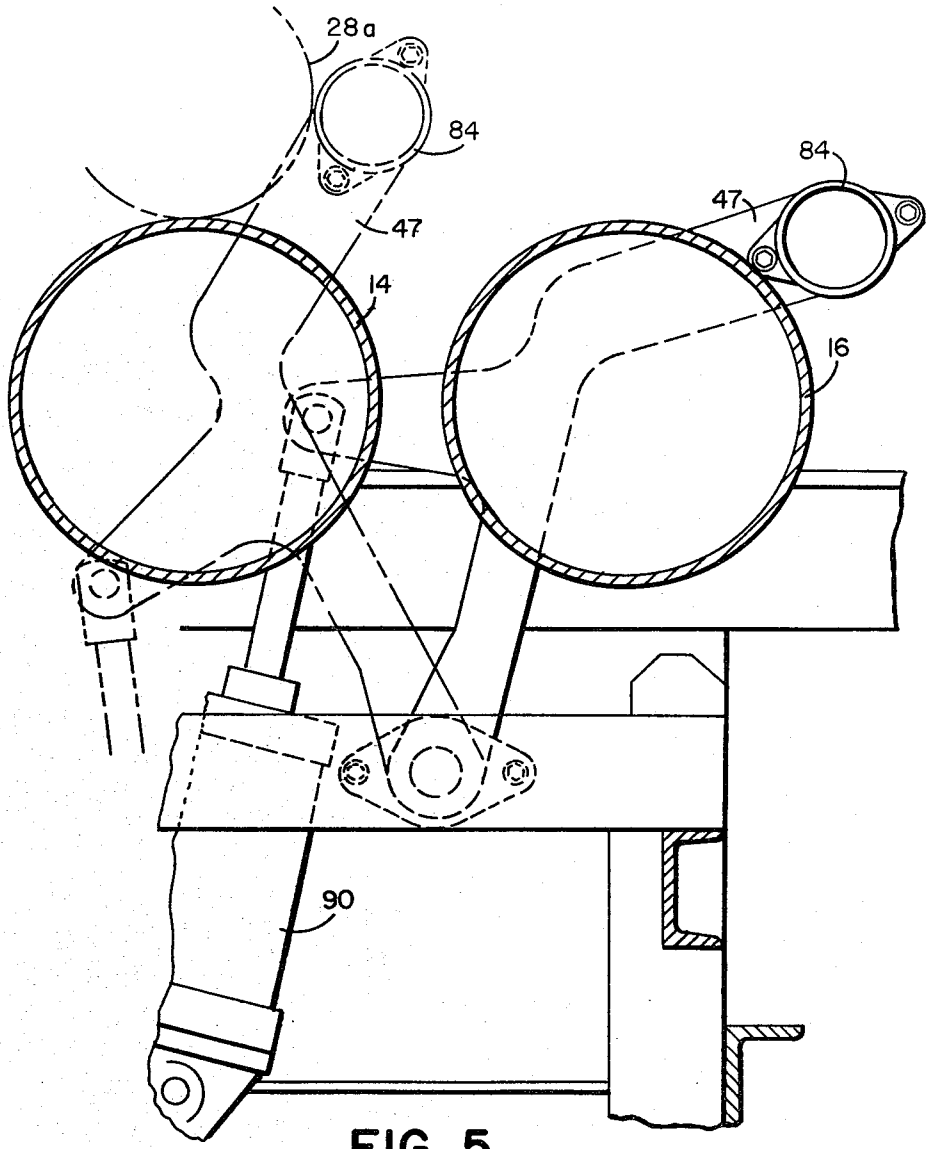
FIG. 5 is a similar view illustrating a roll discharge mechanism of the machine.

FIG. 5 illustrates a roll discharge mechanism which comprises a freely rotating roller 84 supported by arms 88 and movable by fluid cylinders 90. This cylinder can be translated to push or wipe a completed roll **28*a*** from the rollers onto an adjacent conveyor or other transport means.

Figure 6:
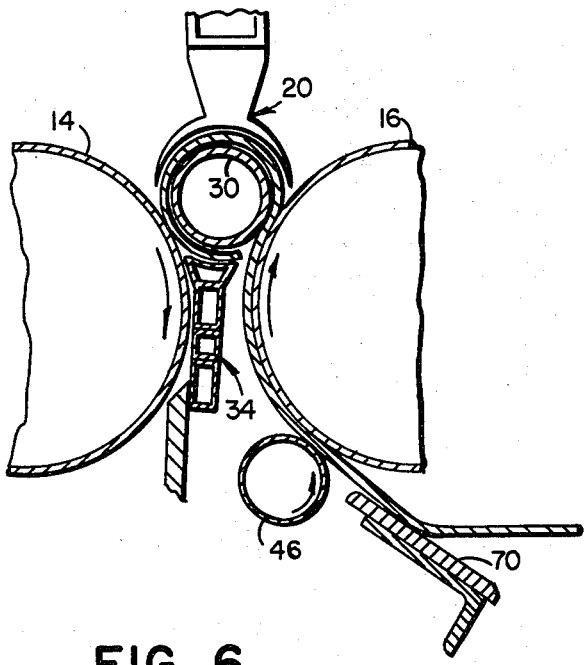
FIG. 6 is a diagrammatic view illustrating the disposition of the movable parts to form a pile-out carpet roll.
Figure 7:
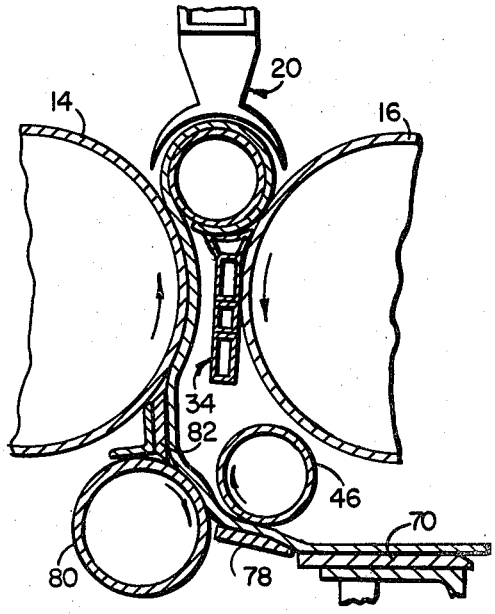
FIG. 7 is a view similar to FIG. 6 but illustrating the disposition of the movable parts to form a pile-in carpet roll.

FIGS. 6 and 7 show the two alternative dispositions of the movable parts to form a pile-out or a pile-in roll, assuming the carpet end to be fed pile up from the right in these figures. As illustrated in FIG. 6 when the gate deflector 70 is pivoted such that its upper surface is disposed upwardly toward the primary feed roller 46, the carpet is fed between the nip between the roller 46 and the roller 16. The roller 46 is positioned substantially against the roller 16 and rotating in a counter-clockwise direction. The direction of the roller 16 is clockwise and the carpet is fed upwardly at the right side of a lower deflector 34 which has been pivoted so that its left lip is in sliding contact with the roller 14. Thus, the carpet is fed along the periphery of the roller 16 until deflected by the lower surface 62 of the upper deflector 20 which has been positioned in the operative position above the lower deflector. The leading edge of the carpet is directed along the arcuate face 62 of the upper reflector and engages the periphery of the roller 14 which is rotating in a clockwise direction. As the leading edge of the carpet is fed downwardly by the roller 14 it engages the arcuate face 48 of the lower deflector 34 and is redirected upwardly by engagement with the upwardly moving carpet fed by the roller 16. Thus, an incipient roll of carpet is formed either about itself as a core or about a tube 30. The upper deflector 20 is thereafter removed to its inoperative position and the remainder of the process continues until a roll of the desired size is formed.

When it is desired to form a pile-in roll, the feed roller 46 is moved against the ramp 78 and the gate deflector 70 is pivoted to a substantially horizontal disposition adjacent the ramp 78. The direction of rotation of the rollers 14, 16, and 46 are reversed relative to that for forming pile-out, and the lower deflector 34 is pivoted so that its right lip is in sliding contact with the roller 16. Thus, the leading edge of the carpet is fed by the primary feed roller 46 over the ramp 78 and by the secondary roller 80, which rotates in a counter-clockwise direction, toward the ramp 82. The latter ramp directs the carpet upwardly toward the left side of the lower deflector against the roller 14, which feeds the carpet up into the arcuate surface 62 of the upper deflector 70. The leading edge is thus redirected downwardly as fed by the roller 16 against the upper face 48 of the lower deflector which again redirects the carpet upwardly to form the incipient roll, the upper deflector thereafter being removed to the rest position.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention what is claimed herein is:

1. A carpet rolling machine comprising a pair of rotatably drivable roll supporting rollers disposed to define a supporting nip on which a roll of carpet can be formed, a lower deflector disposed between the rollers, means for mounting said lower deflector for movement into sliding contact with each of the rollers selectively, said lower deflector having an upwardly facing cam surface, an upper deflector selectively movable from a rest position to an operative position disposed above the lower deflector, said upper deflector having a downwardly facing cam surface, said cam surfaces of said upper and lower deflectors and the periphery of the adjacent rollers together defining a generally cylindrical space to which an end of a piece of carpet can be fed and constrained to follow a cylindrical path when said upper deflector is in said operative position, means for moving said lower deflector into contact with a selected first of the rollers, means for rotating said first roller in a direction such that the surface of said first roller in contact with the lower deflector moves downwardly, means rotating the second roller in a direction relative to said first roller such that the surface of said second roller adjacent to said first roller moves upwardly, and means for feeding and directing the end of said piece of carpet upwardly against the upwardly moving surface of said second roller to feed said carpet into said cylindrical space to form an incipient carpet roll.

2. A carpet rolling machine as recited in claim 1, including means for wiping a formed carpet roll from said supporting rollers after removal of said upper deflector to the rest position.

3. A carpet rolling machine as recited in claim 1, wherein said means for mounting said lower deflector comprises means for pivotably supporting said lower deflector for movement between said roll supporting rollers, and power means for pivoting said lower deflector.

4. A carpet rolling machine as recited in claim 1, wherein said cam surface of each of said upper deflector and said lower deflector is an arcuate surface.

5. A carpet rolling machine as recited in claim 1, wherein said means for feeding and directing the end of said carpet upwardly comprises a ramp deflector, a feed roller disposed intermediate and selectively defining a feed nip between said ramp deflector and one of said supporting rollers, a gate deflector, means for feeding said end of said carpet over said gate deflector, means for moving said gate deflector selectively for directing said carpet either ov .id feed roller to one of said feed nips or under said feed roller to the other of said feed nips, and means for rotating said feed roller in the opposite direction to said support rollers.

6. A carpet rolling machine as recited in claim 5, including pivot means for mounting said gate deflector for pivotable movement relatively to said ramp deflector, and said means for moving said gate deflector comprises power means for pivoting said gate deflector about said pivot means.

7. A carpet rolling machine as recited in claim 5, wherein said feed roller is mounted for bodily movement to close the feed nip defined between the feed roller and said one supporting roller when the carpet is fed over said feed roller and to close the feed nip defined between the feed roller and the ramp deflector when the carpet is fed below said feed roller.

8. A carpet rolling machine as recited in claim 7, wherein said means for feeding and directing said carpet further comprises a second feed roller disposed downstream from said ramp deflector relative to said gate deflector, said second feed roller having a periphery disposed for intersecting carpet fed over said ramp deflector when said carpet is fed below the first mentioned feed roller, and means for rotating said second feed roller in a direction opposite to the first mentioned feed roller when carpet is fed between said ramp deflector and said first mentioned feed roller.

9. A carpet rolling machine as recited in claim 5, wherein said means for feeding and directing said carpet further comprises a second feed roller disposed downstream from said ramp deflector relative to said gate deflector, said second feed roller having a periphery disposed for intersecting carpet fed over said ramp deflector when said carpet is fed below the first mentioned feed roller, and means for rotating said second feed roller in a direction opposite to the first mentioned feed roller when carpet is fed between said ramp deflector and said first mentioned feed roller.

10. A carpet rolling machine as recited in claim 9 or 5, wherein said means for feeding and directing said carpet includes a second ramp deflector intermediate said second feed roller and the other of said supporting rollers for directing carpet from said second feed roller toward and against the periphery of said other supporting roller.

* * * * *

UNITED STATES PATENT AND TRADEMARK OFFICE

CERTIFICATE OF CORRECTION

PATENT NO. : 4,420,124

DATED : December 13, 1983

INVENTOR(S) : Harold B. Bardsley, Brian J. Mosby, John M. Barlow, Brian Walton

It is certified that error appears in the above—identified patent and that said Letters Patent is hereby corrected as shown below:

Claim 5 at column 6, line 12 should read --
said carpet either over said feed roller to one of said feed -

Signed and Sealed this

Sixth Day of March 1984

[SEAL]

*Attest:*

GERALD J. MOSSINGHOFF

*Attesting Officer*

*Commissioner of Patents and Trademarks*